US011695256B2

(12) United States Patent
Sugiura

(10) Patent No.: US 11,695,256 B2
(45) Date of Patent: Jul. 4, 2023

(54) SPARK PLUG FOR INTERNAL COMBUSTION ENGINE

(71) Applicant: DENSO CORPORATION, Kariya (JP)

(72) Inventor: Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/970,092

(22) Filed: Oct. 20, 2022

(65) Prior Publication Data

US 2023/0038174 A1 Feb. 9, 2023

Related U.S. Application Data

(63) Continuation of application No. PCT/JP2021/015304, filed on Apr. 13, 2021.

(30) Foreign Application Priority Data

Apr. 24, 2020 (JP) ..... 2020-077015

(51) Int. Cl.
*H01T 13/54* (2006.01)
*H01T 13/38* (2006.01)
(Continued)

(52) U.S. Cl.
CPC ..... *H01T 13/38* (2013.01); *H01T 13/16* (2013.01); *H01T 13/39* (2013.01); *H01T 13/54* (2013.01)

(58) Field of Classification Search
CPC ..... H01T 13/16; H01T 13/39; H01T 13/54
(Continued)

(56) References Cited

U.S. PATENT DOCUMENTS

2011/0148274 A1 6/2011 Ernst et al.
2017/0104316 A1 4/2017 Niessner et al.
2021/0351573 A1* 11/2021 Cress ..... H01T 13/46

FOREIGN PATENT DOCUMENTS

DE 101 44 976 4/2003
JP 4-366579 12/1992
JP 2015-56258 3/2015

OTHER PUBLICATIONS

International Search Report dated Jul. 13, 2021 issued for International Application No. PCT/JP2021/015304 (2 pages).

* cited by examiner

*Primary Examiner* — Christopher M Raabe
(74) *Attorney, Agent, or Firm* — Nixon & Vanderhye P.C.

(57) ABSTRACT

A spark plug for an internal combustion engine includes insulating glass having a tubular shape, a central electrode including a tip protruding portion, a housing having a tubular shape, and a plug cover provided over an auxiliary combustion chamber. The plug cover is provided with injection holes through which the auxiliary combustion chamber communicates with the exterior. The central electrode includes a base material and a core material disposed inside the base material and having a higher thermal conductivity than the base material. The core material includes a large diameter portion and a small diameter portion continuously formed on a tip side of the large diameter portion. The small diameter portion has a smaller diameter than the large diameter portion, and includes, in a part of the small diameter portion in an axial direction, a small-diameter columnar portion having a constant diameter. At least a part of the small-diameter columnar portion is disposed further on the tip side of the spark plug than a tip of the insulating glass.

2 Claims, 7 Drawing Sheets

(51) Int. Cl.
*H01T 13/16* (2006.01)
*H01T 13/39* (2006.01)

(58) Field of Classification Search
USPC ..... 313/137
See application file for complete search history.

SPARK PLUG FOR INTERNAL COMBUSTION ENGINE

CROSS-REFERENCE TO RELATED APPLICATION

This application is the U.S. bypass application of International Application No. PCT/JP2021/015304, filed on Apr. 13, 2021 which designated the U.S. and claims priority to Japanese Patent Application No. 2020-077015, filed on Apr. 24, 2020, the contents of both of which are incorporated herein by reference.

TECHNICAL FIELD

The present disclosure relates to a spark plug for an internal combustion engine.

BACKGROUND

Some spark plugs for internal combustion engines include, inside a central electrode, a core material that is excellent in thermal conductivity in order to promote heat dissipation at a tip portion of the central electrode, for example, as disclosed in JP 2015-56258 A. In the spark plug disclosed in JP 2015-56258 A, the core material is also disposed in a part of the central electrode that protrudes toward the tip side of the spark plug beyond insulating glass.

SUMMARY

An aspect of the present disclosure provides a spark plug for an internal combustion engine, the spark plug includes insulating glass having a tubular shape, a central electrode held on an inner circumferential side of the insulating glass and including a tip protruding portion protruding from the insulating glass toward a tip side of the spark plug, a housing having a tubular shape and holding the insulating glass on an inner circumferential side of the housing, and a plug cover provided at a tip portion of the housing over an auxiliary combustion chamber in which the tip protruding portion is disposed.

The plug cover is provided with injection holes through which the auxiliary combustion chamber communicates with an exterior, the central electrode includes a base material and a core material disposed inside the base material and having a higher thermal conductivity than the base material, the core material incudes a large diameter portion and a small diameter portion continuously formed on a tip side of the large diameter portion, the small diameter portion has a smaller diameter than the large diameter portion, and includes, in a part of the small diameter portion in an axial direction, a small-diameter columnar portion having a constant diameter, at least a part of the small-diameter columnar portion is disposed further on the tip side of the spark plug than a tip of the insulating glass, and a distance between a discharge gap and the axial injection hole is shorter than a distance between the discharge gap and the tip of the insulating glass in the axial direction.

BRIEF DESCRIPTION OF THE DRAWINGS

The above features of the present disclosure will be made clearer by the following detailed description, given referring to the appended drawings. In the accompanying drawings.

DETAILED DESCRIPTION OF THE PREFERRED EMBODIMENTS

Figure 1:
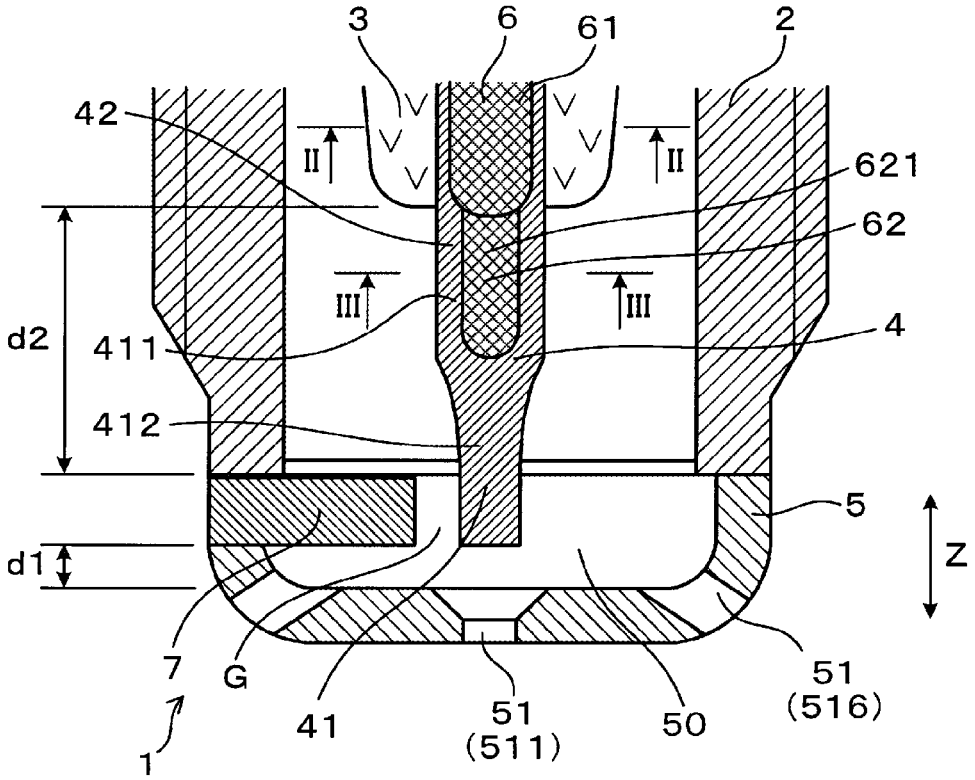
FIG. 1 is a cross-sectional view of a vicinity of a tip portion of a spark plug taken along an axial direction in a first embodiment.

The spark plug described in the background poses the following problems.

That is, one end (hereinafter referred to as a discharge end as appropriate) of discharge that occurs at a discharge gap may move toward a base end side of the spark plug along a side surface of the central electrode exposed from the insulating glass. In this case, when the discharge end reaches a position where the core material is disposed inside, the base material of an area covering an outer circumference of the core material may be gradually exhausted due to discharge. As the exhaustion progresses from the outer circumferential side of the central electrode, the internal core material may be exposed.

An object of the present disclosure is to provide a spark plug for an internal combustion engine that is likely to prevent exposure of the core material.

An aspect of the present disclosure provides a spark plug for an internal combustion engine, the spark plug includes insulating glass having a tubular shape, a central electrode held on an inner circumferential side of the insulating glass and including a tip protruding portion protruding from the insulating glass toward a tip side of the spark plug, a housing having a tubular shape and holding the insulating glass on an inner circumferential side of the housing, and a plug cover provided at a tip portion of the housing over an auxiliary combustion chamber in which the tip protruding portion is disposed.

The plug cover is provided with injection holes through which the auxiliary combustion chamber communicates with an exterior, the central electrode includes a base material and a core material disposed inside the base material and having a higher thermal conductivity than the base material, the core material incudes a large diameter portion and a small diameter portion continuously formed on a tip side of the large diameter portion, the small diameter portion has a smaller diameter than the large diameter portion, and includes, in a part of the small diameter portion in an axial direction, a small-diameter columnar portion having a constant diameter, at least a part of the small-diameter columnar portion is disposed further on the tip side of the spark plug than a tip of the insulating glass, and a distance between a discharge gap and the axial injection hole is shorter than a distance between the discharge gap and the tip of the insulating glass in the axial direction.

In the spark plug for the internal combustion engine, the core material in the central electrode includes a large diameter portion and a small diameter portion. At least a part of the small-diameter columnar portion in the small diameter portion is disposed further on the tip side of the spark plug than the tip of the insulating glass. This is likely to prevent exposure of the core material caused by exhaustion of the central electrode from the outer circumferential side.

As described above, according to the above-described aspect, a spark plug for an internal combustion engine can be provided that is likely to prevent exposure of the core material.

First Embodiment

Embodiments related to a spark plug for an internal combustion engine will be described with reference to FIGS. 1 to 4.

As illustrated in FIG. 1, a spark plug 1 for an internal combustion engine in the present embodiment includes insulating glass 3 having a tubular shape, a central electrode 4, a housing 2 having a tubular shape, and a plug cover 5.

The central electrode 4 is held on an inner circumferential side of the insulating glass 3. Additionally, the central electrode 4 includes a tip protruding portion 41 protruding from the insulating glass 3 toward a tip side of the spark plug. The housing 2 holds the insulating glass 3 on the inner circumferential side of the housing 2. The plug cover 5 is provided at a tip portion of the housing 2 over an auxiliary combustion chamber 50 in which the tip protruding portion 41 is disposed. The plug cover 5 is provided with injection holes 51 through which the auxiliary combustion chamber 50 communicates with the exterior.

Figure 2:
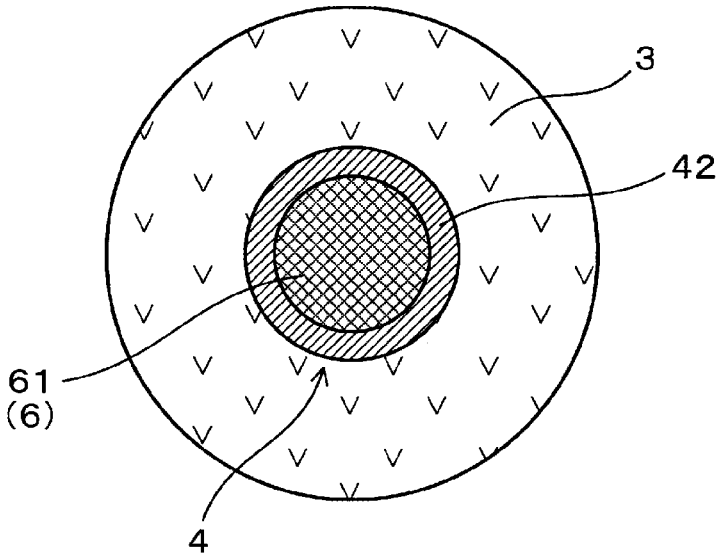
FIG. 2 is a cross-sectional view taken along line II-II in FIG. 1.
Figure 3:
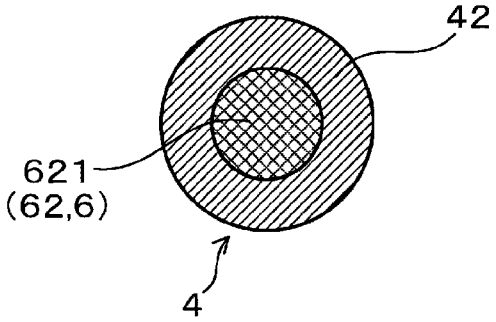
FIG. 3 is a cross-sectional view taken along line in FIG. 1.

As illustrated in FIGS. 1 to 3, the central electrode 4 includes a base material 42 and a core material 6. The core material 6 is disposed in the base material 42 and has a higher thermal conductivity than the base material 42. The core material 6 includes a large diameter portion 61 and a small diameter portion 62 continuously formed on a tip side of the large diameter portion 61.

The small diameter portion 62 has a smaller diameter than the large diameter portion 61. The small diameter portion 62 includes a small-diameter columnar portion 621. The small-diameter columnar portion 621 is at least a part of the small diameter portion 62 in an axial direction Z, the part having a constant diameter. At least a part of the small-diameter columnar portion 621 is disposed further on the tip side of the spark plug than a tip of the insulating glass 3.

The spark plug 1 in the present embodiment can be used, for example, as an ignition means for an internal combustion engine in an automobile, cogeneration apparatus, or the like. Then, one axial end of the spark plug 1 is disposed in a combustion chamber of the internal combustion engine. The combustion chamber of the internal combustion engine is referred to as a "main combustion chamber 11," compared to the "auxiliary combustion chamber 50" described above. In an axial direction Z of the spark plug 1, a side exposed to the main combustion chamber 11 is intended to be referred to as the tip side, whereas the opposite side is intended to be referred to as a base end side.

Figure 4:
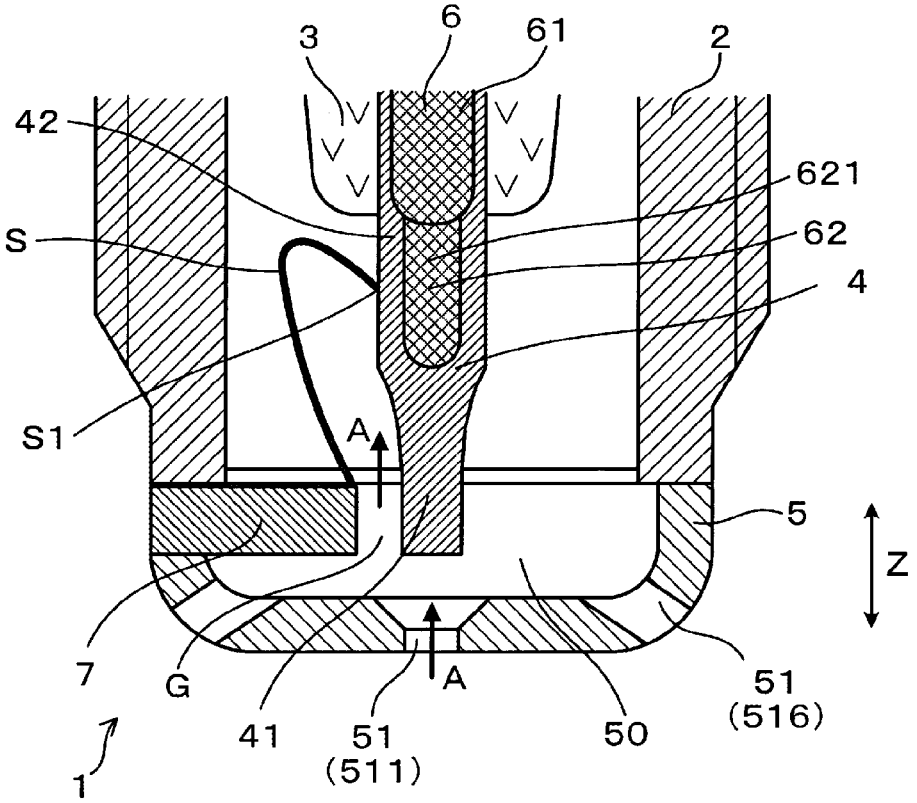
FIG. 4 is a cross-sectional view illustrating how discharge is extended in the first embodiment.
Figure 5:
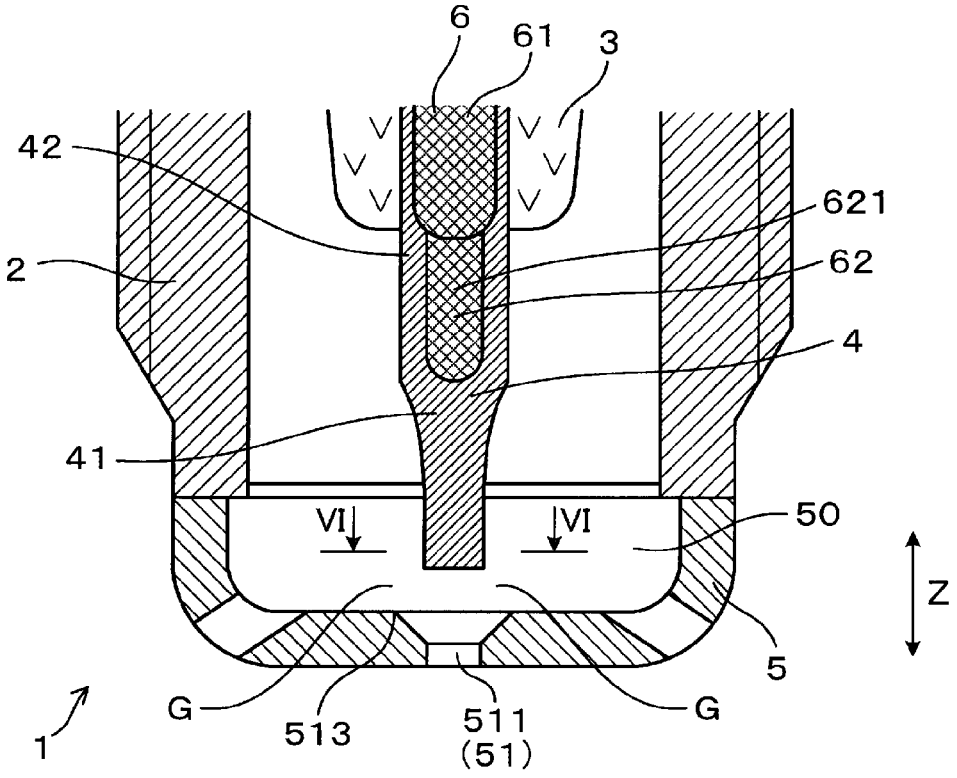
FIG. 5 is a cross-sectional view of a vicinity of a tip portion of a spark plug along the axial direction in a second embodiment.

The plug cover 5 is joined to the tip portion of the housing 2 by welding or the like. With the spark plug 1 attached to the internal combustion engine, the plug cover 5 separates the auxiliary combustion chamber 50 from the main combustion chamber 11. As illustrated in FIG. 1, in the present embodiment, the plug cover 5 is provided with a plurality of the injection holes 51. Flame produced in the auxiliary combustion chamber 50 is injected into the main combustion chamber 11 through the injection holes 51. As illustrated in FIG. 4, during a compression stroke and the like of the internal combustion engine, an air stream A is introduced from the main combustion chamber 11 into the auxiliary combustion chamber 50 through the injection holes 51.

At least one of the injection holes 51 is an axial injection hole 511 opening in the axial direction Z. In the present embodiment, the plug cover 5 includes one axial injection hole 511 and a plurality of lateral injection holes 516. The axial injection hole 511 is formed at a position overlapping the central electrode 4 in the axial direction Z. The lateral injection holes 516 are formed on an outer circumferential side of the axial injection hole 511 and are inclined in such a manner that, toward the tip side of the spark plug, the lateral injection hole 516 extends further toward the outer circumferential side.

The axial injection hole 511 includes a chamfered portion 512 at an opening end on the auxiliary combustion chamber 50 side. The chamfered portion 512 is tapered in such a manner that the axial injection hole 511 has a diameter increasing toward the base end side of the spark plug.

The spark plug 1 in the present embodiment includes a ground electrode 7 disposed on the outer circumferential side of and opposite to the tip protruding portion 41 of the central electrode 4. The ground electrode 7 is joined to a part of the plug cover 5 near the junction between the plug cover 5 and the housing 2. A discharge gap G is formed between the ground electrode 7 and the tip protruding portion 41 of the central electrode 4. That is, the discharge gap G is formed facing a part of an outer circumferential surface of the tip protruding portion 41.

As illustrated in FIG. 1, a distance d1 in the axial direction Z between the discharge gap G and the axial injection hole 511 is shorter than a distance d2 in the axial direction between the discharge gap G and the tip of the insulating glass 3. Note that in the present embodiment, the distance d1 is larger than the magnitude of the discharge gap G. The discharge gap G is smaller than the minimum distance between the central electrode 4 and the plug cover 5.

The base material 42 of the central electrode 4 is formed of a metal or an alloy that is excellent in heat resistance. The base material 42 can be formed of a nickel (Ni)-based alloy, for example, Inconel (registered trademark). The core material 6 of the central electrode 4 is formed of a metal or an alloy that is excellent in thermal conductivity. The core material 6 can be formed of, for example, copper or a copper alloy. The plug cover 5 and the ground electrode 7 can each be formed of, for example, a nickel-based alloy.

As illustrated in FIGS. 1 to 3, the central electrode 4 has a generally cylindrical shape. In a cross section orthogonal to the axial direction Z, an outer circumferential contour of the core material 6 is substantially concentric with an outer circumferential contour of the central electrode 4 as illustrated in FIGS. 2 and 3. As illustrated in FIG. 1, a boundary portion between the large diameter portion 61 and the small diameter portion 62 of the core material 6 is located at the same position as that of the tip of the insulating glass 3 in the axial direction Z.

As illustrated in FIG. 1, the large diameter portion 61 has an approximately constant diameter except for a part of the tip portion of the large diameter portion 61. The small diameter portion 62 also has an approximately constant diameter except for a part of the tip portion of the small diameter portion 62. The part of the small diameter portion 62 having an approximately constant diameter corresponds to the small-diameter columnar portion 621. A part of the small diameter portion 62 located further on the tip side of the spark plug than the small-diameter columnar portion 621 has a convexly curved cross-sectional shape along the axial direction Z.

The tip protruding portion 41 of the central electrode 4 includes a first area 411 having a diameter equivalent to that of a part of the central electrode 4 disposed inside the insulating glass 3. The tip protruding portion 41 includes a second area 412 located further on the tip side of the spark plug than the first area 411 and having a smaller diameter than the first area 411. A tip of the core material 6, that is, a tip of the small diameter portion 62 of the core material 6, is located at a position substantially equivalent to that of a tip of the first area in the axial direction Z. The discharge gap G is formed on the outer circumferential side of the second area 412. In other words, all or most of the second area 412 is formed of the base material 42.

The large diameter portion 61 and the small diameter portion 62 of the core material 6 are both formed in an area of the central electrode 4 having substantially the same diameter. Accordingly, a part of the base material 42 covering the outer circumferential side of the small diameter portion 62 has a larger thickness than a part of the base material 42 covering the outer circumferential side of the large diameter portion 61.

In the present embodiment, a base end of the small diameter portion 62 is formed at a portion substantially equivalent to that of the tip of the insulating glass 3. Note that in order to more reliably prevent exposure of the core material 6, the base end of the small diameter portion 62 is desirably located further on the base end side of the spark plug than the tip of the insulating glass 3.

Now, effects of the present embodiment will be described.

In the spark plug 1 for the internal combustion engine, the core material 6 of the central electrode 4 includes the large diameter portion 61 and the small diameter portion 62. At least a part of the small-diameter columnar portion 621 of the small diameter portion 62 is disposed further on the tip side of the spark plug than the tip of the insulating glass 3. This is likely to prevent exposure of the core material 6 caused by exhaustion of the central electrode 4 from the outer circumferential side.

By applying a voltage between the ground electrode 7 and the central electrode 4 in the spark plug 1, discharge is formed at the discharge gap G. At this time, when the discharge gap G contains an air stream A flowing toward the base end side of the spark plug, the discharge S is extended toward the base end side by the air stream A as illustrated in FIG. 4. In particular, the air stream A flows into the auxiliary combustion chamber 50 through the axial injection hole 511, and thus an air stream A flowing toward the base end side of the spark plug is generated in the discharge gap G. That is, for example, in a case where the discharge S is caused during the compression stroke of the internal combustion engine, the discharge S is extended toward the base end side of the spark plug by the air stream A flowing into the auxiliary combustion chamber 50 through the axial injection hole 511 and passing through the discharge gap G toward the base end side.

Then, a discharge end S1 of the discharge S on the central electrode 4 side moves toward the base end side of the spark plug along a side surface of the central electrode 4. A discharge end S1 exhausts the central electrode 4 only gradually. An outer layer of the central electrode 4 is formed of the base material 42, and thus the central electrode 4 is prevented from being melted but is exhausted. Accordingly, assuming an area of the base material 42 covering the outer circumferential side of the core material 6 is exhausted by an amount corresponding to the thickness of the area, the core material 6, located inside, is exposed. In a case where the core material 6 is formed of a material having a relatively low melting point, for example, a copper alloy, the core material 6, when externally exposed, may be dissolved. When such a situation occurs, the central electrode 4 may have degraded heat dissipation properties, leading to a defect such as preignition.

Thus, to prevent the core material 6 from being exposed, the core material 6 may have a reduced diameter and the base material 42, covering the outer circumference of the core material 6, may have an increased thickness. However, simply thinning the core material 6 is likely to degrade the heat dissipation properties of the central electrode 4. Accordingly, also in this case, the effect of suppressing preignition may be degraded.

In the spark plug 1 in the present embodiment, the core material 6 is provided with the large diameter portion 61 and the small diameter portion 62, and the small diameter portion 62 is provided in the tip protruding portion 41, which is more likely to be exhausted than the other portions of the central electrode 4. Thus, the present structure is likely to prevent exposure of the core material 6, while maximally ensuring the heat dissipation properties of the core material 6. Furthermore, the small diameter portion 62 of the core material 6 includes the small-diameter columnar portion 621, and the small-diameter columnar portion 621 is disposed in the tip protruding portion 41. This allows exposure of the core material 6 to be prevented, while maximally ensuring the thermal conductivity of the tip protruding portion 41. As a result, the spark plug 1 can be obtained that is, as a whole, likely to prevent exposure of the core material 6, while maximally ensuring the heat dissipation properties of the central electrode 4.

In the spark plug 1 in the present embodiment, the plug cover 5 includes the axial injection holes 511. In this case, the air stream A flowing toward the base end side as described above is likely to be generated at the discharge gap G. Then, a phenomenon is likely to occur in which the discharge end S1 moves to the outer circumferential surface of the area of the central electrode 4 in which the core material 6 is present. In the spark plug 1 as described above, when the central electrode 4 has a structure that is likely to prevent exposure of the core material 6, the life of the spark plug 1 can be effectively extended.

The distance d1 between the discharge gap G and the axial injection hole 511 in the axial direction Z is shorter than the distance d2 between the discharge gap G and the tip of the insulating glass 3 in the axial direction Z. In this case, in particular, when the air stream A flows into the auxiliary combustion chamber 50 through the axial injection hole 511, an air stream flowing toward the base end side of the spark plug is likely to be generated at the discharge gap G. Accordingly, adoption of the structure of the central electrode 4 described above allows the life of the spark plug 1 to be effectively extended.

As described above, the present embodiment can provide a spark plug for an internal combustion engine that is likely to prevent exposure of the core material.

Second Embodiment

In the present embodiment, the discharge gap G is formed between the central electrode 4 and the plug cover 5 as illustrated in FIGS. 5 to 8.

In the present embodiment, the ground electrode 7, disclosed in the first embodiment, is not provided. However, a part of an inner circumferential edge of the axial injection hole 511 in the plug cover 5 faces a tip of the central electrode 4. The discharge gap G is formed between the part of the inner circumferential edge of the axial injection hole 511 and the tip of the central electrode 4. Consequently, the part of the inner circumferential edge of the axial injection hole 511 in the plug cover 5 functions as a ground electrode.

Figure 6:
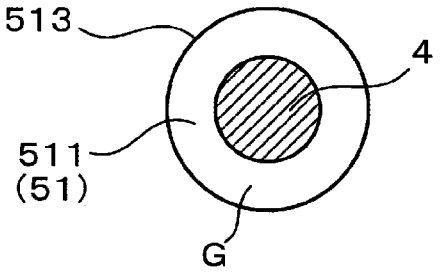
FIG. 6 is a cross-sectional view taken along line VI-VI in FIG. 5.

More specifically, the discharge gap G is formed between the tip of the central electrode 4 and an edge 513 on the auxiliary combustion chamber 50 side of the axial injection hole 511. In the present embodiment, the discharge gap G is circumferentially formed all around the circumference of the central electrode 4, as illustrated in FIG. 6.

Figure 7:
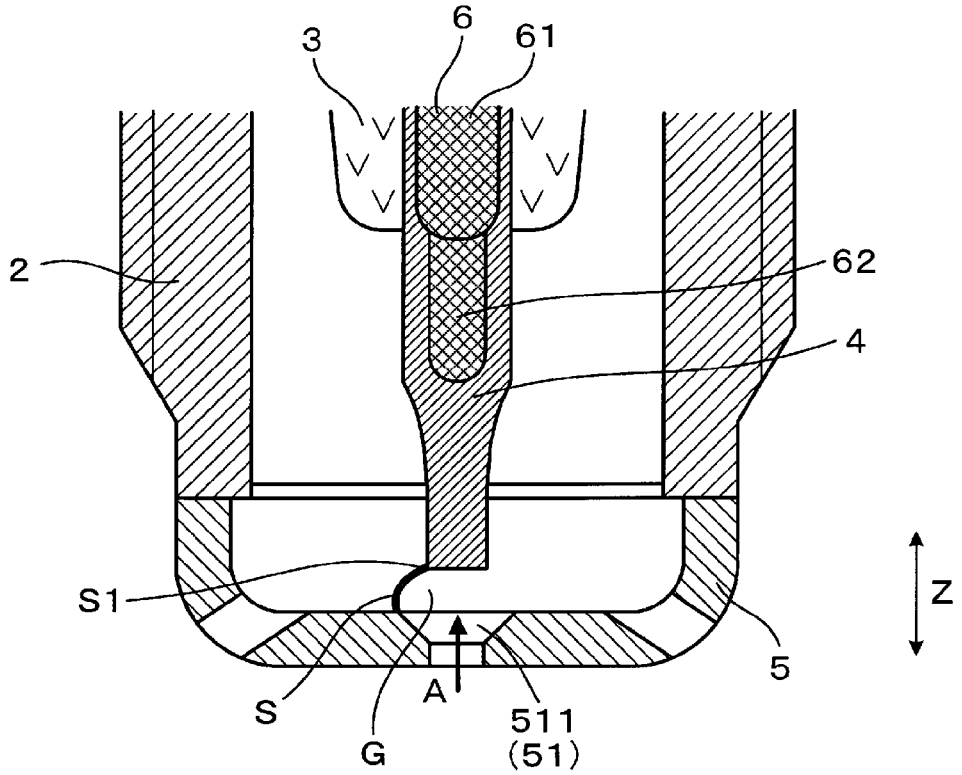
FIG. 7 is a cross-sectional view illustrating that discharge is formed in the second embodiment.
Figure 8:
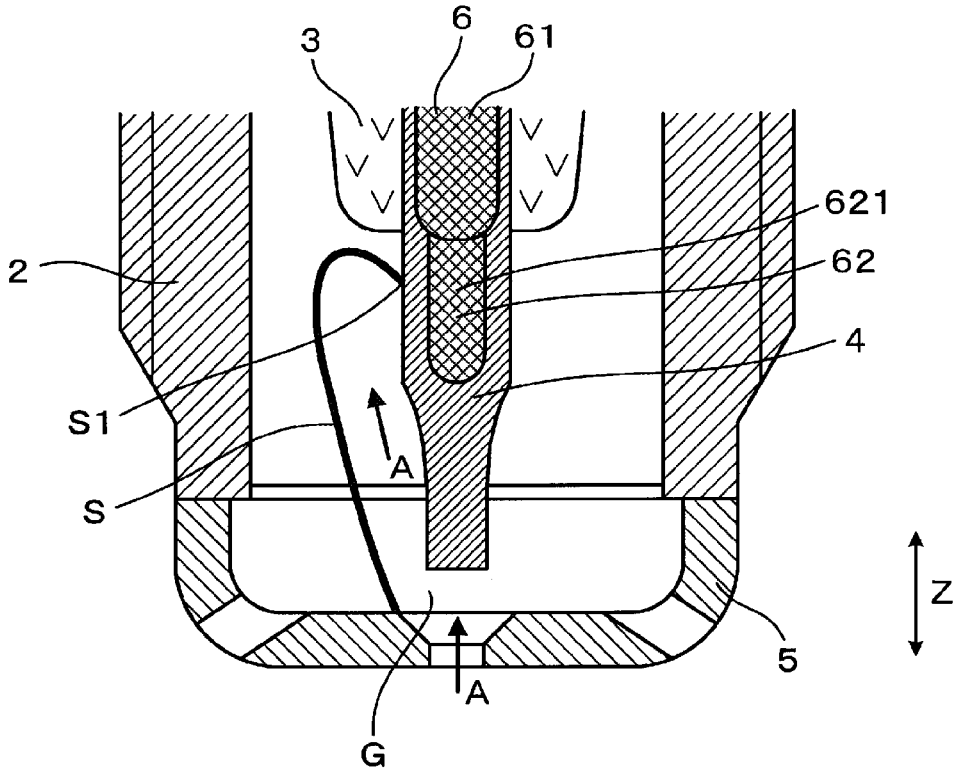
FIG. 8 is a cross-sectional view illustrating that discharge is extended in the second embodiment.

In the spark plug 1 in the present embodiment, by applying a voltage to the central electrode 4, the discharge S is formed at the discharge gap G as illustrated in FIG. 7. Then, when flowing into the auxiliary combustion chamber 50 through the axial injection hole 511, the air stream A extends the discharge S toward the base end side as illustrated in FIG. 8. At this time, the discharge end S1 on the central electrode 4 side moves toward the base end side of the spark plug along the side surface of the central electrode 4.

As described above, in the present embodiment, the discharge gap G is formed all around the circumference of the central electrode 4, movement of the discharge end S1 along the outer circumferential surface of the central electrode 4 may occur at any position of the central electrode 4 in the circumferential direction. However, for example, by adjusting the positional relationship between the central electrode 4 and the axial injection hole 511, the formation position of the discharge S can be controlled.

The structure of the central electrode 4 such as the arrangement of the core material 6 in the second embodiment is similar to that in the first embodiment.

The second embodiment is otherwise similar to the first embodiment. Note that for the reference signs used in the second embodiment and subsequent embodiments, the same reference signs as those used in the foregoing embodiments represent components or the like similar to those in the foregoing embodiments unless otherwise indicated.

Like the first embodiment, the present embodiment is also likely to prevent exposure of the core material 6 caused by exhaustion of the central electrode 4 from the outer circumferential side.

The second embodiment produces effects similar to those of the first embodiment.

Third Embodiment

Figure 9:
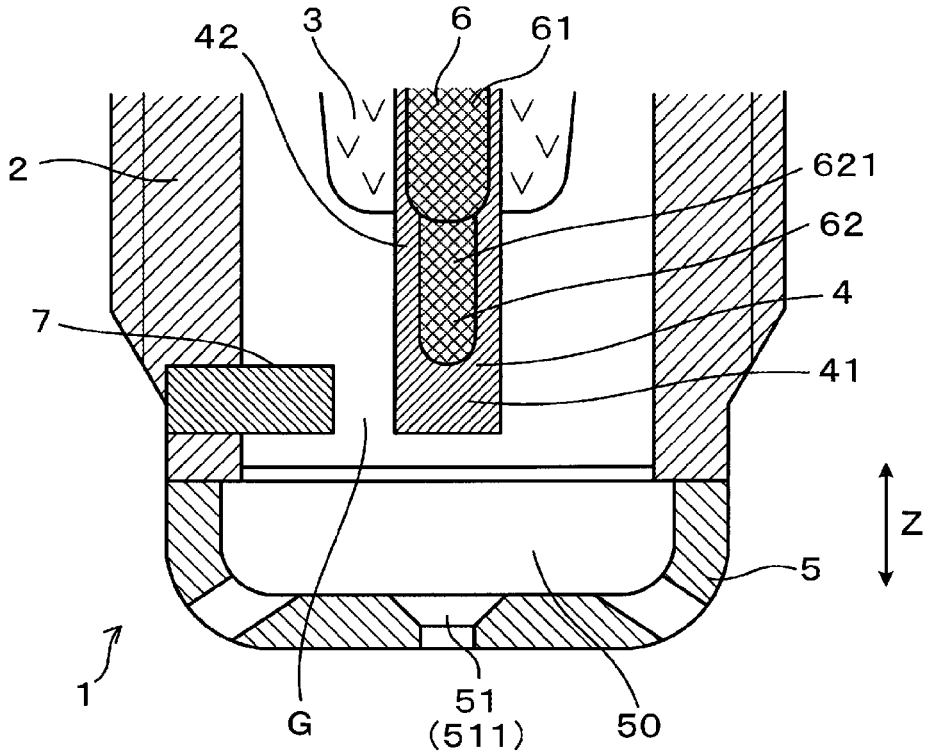
FIG. 9 is a cross-sectional view of a vicinity of a tip portion of a spark plug along the axial direction in a third embodiment.

In the present embodiment, as illustrated in FIG. 9, the ground electrode 7 protrudes from the housing 2 inward in the radial direction.

That is, in the spark plug 1 in the present embodiment, the ground electrode 7 is joined to the housing 2. The discharge gap G is formed between a protruding end of the ground electrode 7 and the outer circumferential surface of the central electrode 4. In the present embodiment, the discharge gap G is formed further on the base end side of the spark plug than a tip of the housing 2. The tip of the central electrode 4 is also disposed further on the base end side of the spark plug than the tip of the housing 2.

The third embodiment is otherwise similar to the first embodiment.

The third embodiment produces effects similar to those of the first embodiment.

Fourth Embodiment

Figure 10:
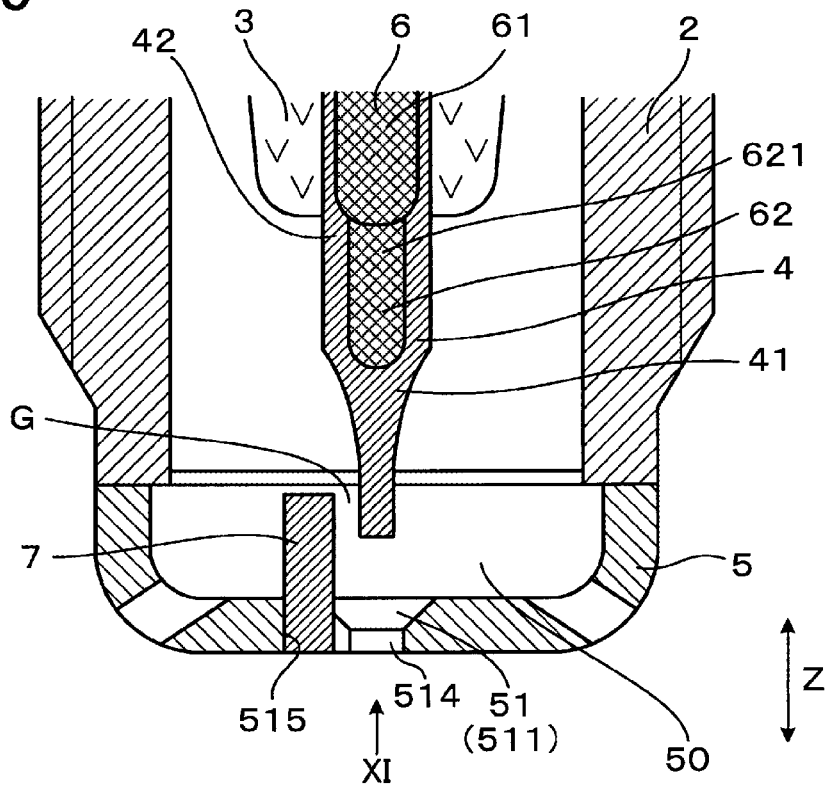
FIG. 10 is a cross-sectional view of a vicinity of a tip portion of a spark plug along the axial direction in a fourth embodiment.

In the present embodiment, as illustrated in FIG. 10, the ground electrode 7 is joined to the plug cover 5 and protrudes from the plug cover 5 toward the base end side of the spark plug.

In the present embodiment, the ground electrode 7 is joined to an inner circumferential surface of the axial injection hole 511. The ground electrode 7 is erected along the axial direction Z. The ground electrode 7 protrudes into the auxiliary combustion chamber 50. The protruding end of the ground electrode 7 is located further on the base end side of the spark plug than the tip of the central electrode 4 in the axial direction Z. The ground electrode 7 forms the discharge gap G between the side surface on the axial injection hole 511 side and the central electrode 4.

Figure 11:
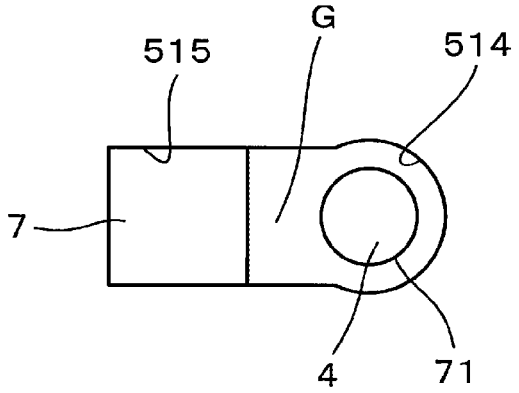
FIG. 11 is a diagram of a portion indicated by an arrow XI in FIG. 10.

In the present embodiment, as illustrated in FIG. 11, the axial injection hole 511 includes a main hole portion 514 formed substantially coaxially with the central electrode 4 and an extended hole portion 515 formed by extending the main hole portion 514 outward in a radial direction of the main hole portion 514. A part of the ground electrode 7 is disposed in the extended hole portion 515. The ground electrode 7 is joined to an inner circumferential surface of the extended hole portion 515.

The fourth embodiment is otherwise similar to the first embodiment.

In the present embodiment, an air stream flowing from the axial injection hole 511 into the auxiliary combustion chamber 50 is likely to be guided through the discharge gap G toward the base end side of the spark plug along the side surface of the ground electrode 7. Accordingly, during the compression stroke and the like, the discharge is likely to be extended, allowing ignitability to be improved. Then, the discharge end is likely to move toward the base end side of the tip protruding portion 41. In the spark plug 1 as described above, the small diameter portion 62 of the core material 6 of the central electrode 4 is disposed in the tip protruding portion 41, thus allowing exposure of the core material 6 to be more effectively suppressed.

The fourth embodiment produces effects similar to those of first embodiment.

Fifth Embodiment

Figure 12:
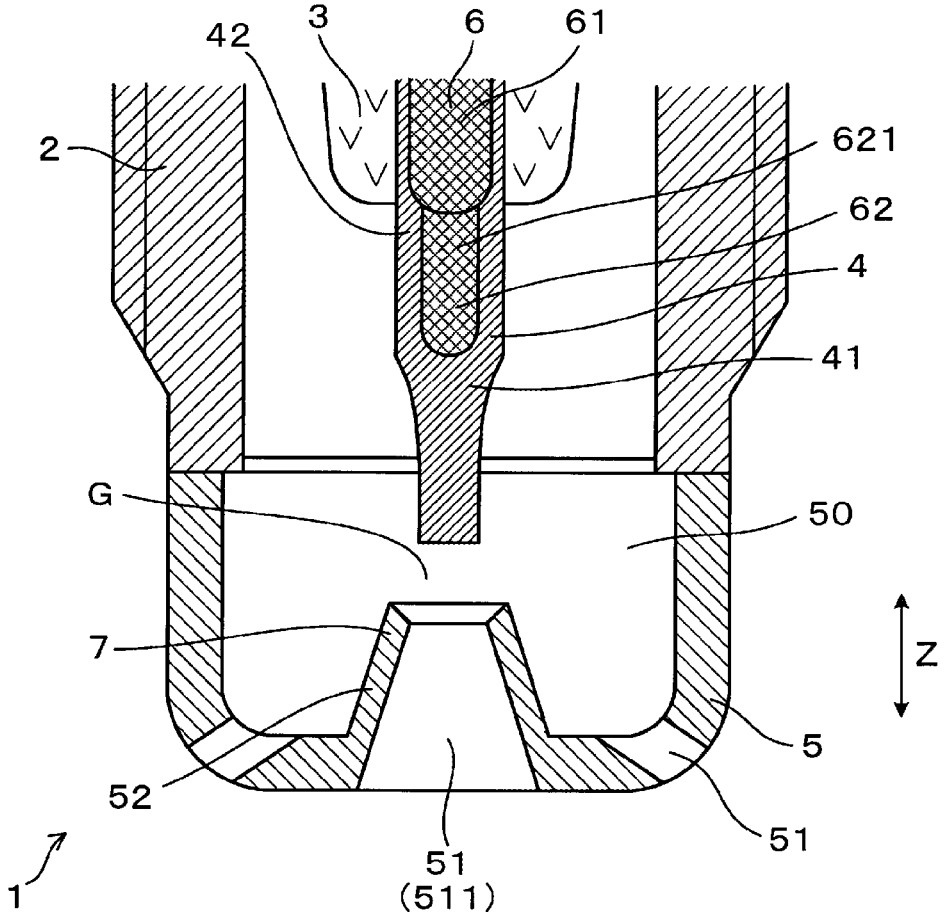
FIG. 12 is a cross-sectional view of a vicinity of a tip portion of a spark plug along the axial direction in a fifth embodiment.

In the present embodiment, as illustrated in FIG. 12, the spark plug 1 includes a protruding tubular body 52 protruding from a tip of the plug cover 5 toward the auxiliary combustion chamber 50 side.

The protruding tubular body 52 functions as the ground electrode 7.

The protruding tubular body 52 has a generally conical shape having a diameter decreasing from a tip portion toward a base end side of the protruding tubular body 52. The protruding tubular body 52 penetrates the plug cover 5 in the Z direction. A penetration space inside the protruding tubular body 52 forms the axial injection hole 511. The discharge gap G is formed between a base end of the protruding tubular body 52 and the tip of the central electrode 4. The discharge gap G is formed all around the circumference of the tip portion of the central electrode 4.

The structure of the central electrode 4 is similar to that in the first embodiment.

The fifth embodiment is otherwise similar to the first embodiment.

The fifth embodiment also produces effects similar to those of the first embodiment.

Sixth Embodiment

Figure 13:
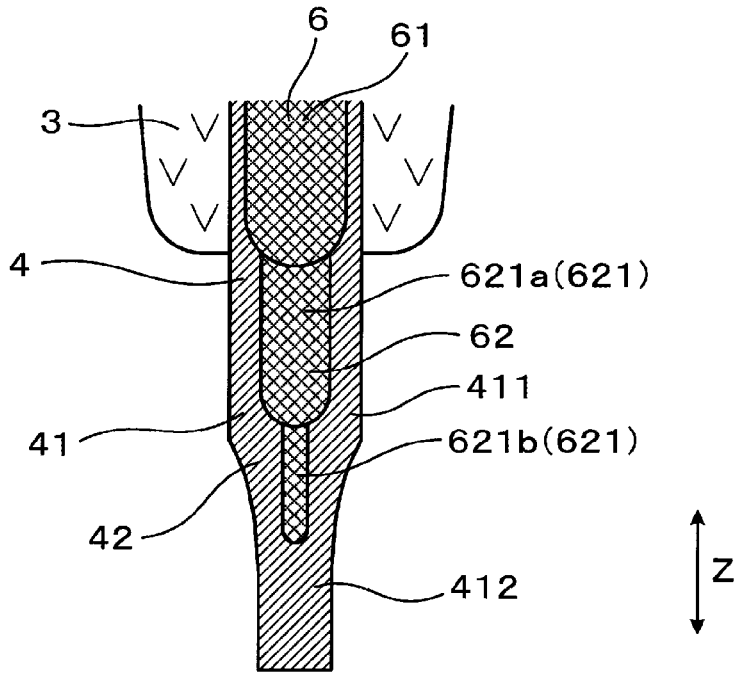
FIG. 13 is a cross-sectional view of a vicinity of a tip protruding portion of a central electrode along the axial direction in a sixth embodiment.

In the present embodiment, as illustrated in FIG. 13, the small diameter portion 62 in the core material 6 of the central electrode 4 includes a first small-diameter columnar portion 621*a* and a second small-diameter columnar portion 621*b* having different diameters.

The second small-diameter columnar portion 621*b* has a smaller diameter than the first small-diameter columnar portion 621*a*. The second small-diameter columnar portion 621*b* is formed continuously on the tip side of the first small-diameter columnar portion 621*a*. The first small-diameter columnar portion 621*a* has a smaller diameter than the large diameter portion 61.

The second small-diameter columnar portion 621*b* is disposed in the second area 412 of the tip protruding portion 41 of the central electrode 4. That is, the second small diameter portion 621*b* is disposed inside the second area 412 corresponding to an area of the tip protruding portion 41 having a smaller diameter than the first area 411, the second small diameter portion 621*b* having a smaller diameter than the first small-diameter columnar portion 621*a*.

The sixth embodiment is otherwise similar to the first embodiment.

In the present embodiment, the core material 6 can be located as close as possible to the tip of the central electrode 4, with exposure of the core material 6 suppressed. As a result, the heat dissipation properties of the central electrode 4 can be improved, allowing preignition to be made more likely to be prevented. The second small diameter portion 621*b* having a smaller diameter. is disposed inside the second area 412 having a smaller diameter than the first area 411, thus ensuring the thickness of the base material 42 on the outer circumferential side of the second small-diameter columnar portion 621*b*. This enables suppression of exposure of the small-diameter columnar portion 621 caused by exhaustion of the base material 42.

The sixth embodiment otherwise produces effects similar to those of the first embodiment.

In the present embodiment illustrated, the small diameter portion 62 includes the two small-diameter columnar portions 621*a* and 621*b*. However, in the present embodiment, the small diameter portion 62 includes three or more different small-diameter columnar portions. In this case, these small-diameter columnar portions are arranged in such a manner that small-diameter columnar portions located further on the tip side of the spark plug have smaller diameters.

Seventh Embodiment

Figure 14:
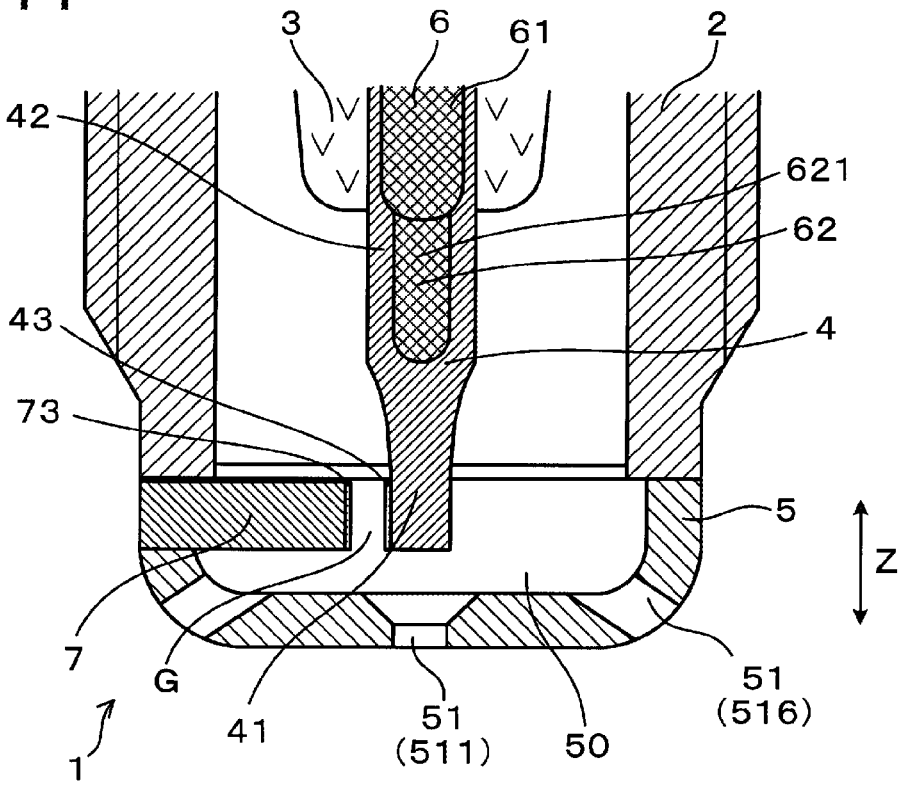
FIG. 14 is a cross-sectional view of a vicinity of a tip portion of a spark plug along the axial direction in a seventh embodiment.

In the present embodiment, as illustrated in FIG. 14, noble metal chips 43 and 73 are joined to those areas of the central electrode 4 and the ground electrode 7 which face the discharge gap G.

The noble metal chips 43 and 73 can be formed of, for example, noble metal such as iridium or platinum or an alloy thereof.

The seventh embodiment is otherwise similar to the first embodiment.

In the present embodiment, expansion of the discharge gap G is suppressed, allowing the life of the spark plug 1 to be extended.

The seventh embodiment produces effects similar to those of the first embodiment.

Note that the present embodiment can be varied in such a manner that the noble metal chip is joined to only one of the central electrode 4 and the ground electrode 7. The other embodiments described above can be similarly varied as appropriate in such a manner that the noble metal chip is joined to at least one of the central electrode 4 and the ground electrode 7.

The present disclosure is not limited to the above-described embodiments but can be applied to various embodiments without departing from the spirits of the disclosure.

The present disclosure has been described in accordance with the embodiments, but it is appreciated that the present disclosure is not limited to the embodiments or structures. The present disclosure includes many varied examples and variations within the range of equivalency. In addition, the category or conceptual range of the present disclosure includes various combinations and forms and further other combinations and forms corresponding to the various combinations and forms including only one additional element, more than one additional elements, or an additional portion of one element.

What is claimed is:

1. A spark plug for an internal combustion engine, the spark plug comprising: insulating glass having a tubular shape; a central electrode held on an inner circumferential side of the insulating glass and comprising a tip protruding portion protruding from the insulating glass toward a tip side of the spark plug; a housing having a tubular shape and holding the insulating glass on an inner circumferential side of the housing; and a plug cover provided at a tip portion of the housing over an auxiliary combustion chamber in which the tip protruding portion is disposed, wherein the plug cover is provided with injection holes through which the auxiliary combustion chamber communicates with an exterior, the central electrode comprises a base material and a core material disposed inside the base material and having a higher thermal conductivity than the base material, the core material comprises a large diameter portion and a small diameter portion continuously formed on a tip side of the large diameter portion, the small diameter portion has a smaller diameter than the large diameter portion, and comprises, in a part of the small diameter portion in an axial direction, a small-diameter columnar portion having a constant diameter, at least a part of the small-diameter columnar portion is disposed further on the tip side of the spark plug than a tip of the insulating glass, and a distance between a discharge gap and an axial injection hole is shorter than a distance between the discharge gap and the tip of the insulating glass in the axial direction.

2. The spark plug for the internal combustion engine according to claim 1, wherein at least one of the injection holes is an axial injection hole that is open in the axial direction.

* * * * *